US006672998B2

(12) United States Patent
Cook

(10) Patent No.: US 6,672,998 B2
(45) Date of Patent: Jan. 6, 2004

(54) PNEUMATIC ASSISTED EXERCISE BENCH

(76) Inventor: Gerry Cook, 3115 N. Boyer Ave., Sandpoint, ID (US) 83864

( * ) Notice: Subject to any disclaimer, the term of this patent is extended or adjusted under 35 U.S.C. 154(b) by 149 days.

(21) Appl. No.: 09/989,979

(22) Filed: Nov. 20, 2001

(65) Prior Publication Data

US 2002/0065178 A1 May 30, 2002

Related U.S. Application Data

(60) Provisional application No. 60/253,187, filed on Nov. 27, 2000.

(51) Int. Cl.[7] ..... A63B 26/00

(52) U.S. Cl. ..... 482/142; 482/148; 482/907; 602/32

(58) Field of Search ..... 482/112, 92, 72, 482/14, 96, 97, 143–146, 907, 148, 903, 137, 136, 8, 134, 113, 111, 138, 133; 602/32; 128/25 R, 28 R; 272/94, 129, 130, 134, 93, 96, 125, 131, 132, 142

(56) References Cited

U.S. PATENT DOCUMENTS 3,060,929 A * 10/1962 Zivi ..... 128/75
4,185,818 A * 1/1980 Brentham ..... 272/130
4,768,779 A 9/1988 Oehman, Jr. et al.
4,893,808 A 1/1990 McIntyre et al.
5,277,681 A 1/1994 Holt
5,324,247 A 6/1994 Lepley
5,346,452 A 9/1994 Ku
5,676,627 A 10/1997 Howse
6,440,046 B1 * 8/2002 Tholkes ..... 482/142

* cited by examiner

*Primary Examiner*—Stephen R. Crow
*Assistant Examiner*—Lori Amerson
(74) *Attorney, Agent, or Firm*—Richard G. Conover

(57) ABSTRACT

The present invention includes a bench mounted to a base frame. A foot truck is slidably mounted to the bench to secure the feet of the user. A tiltable upper body support is mounted to the base. A first belt is provided for securing the legs of a user to the bench. A second belt is provided for securing the pelvic area of the user to the base. A third belt is connected to a support slidably mounted to the upper body support for mounting in a vertical direction. The third belt is used to secure the user to the upper body support. A first pneumatic cylinder is provided for extending the foot track to a selected forward position. A second pneumatic cylinder is provided for tilting the upper body support to a selected tilt position. A third pneumatic cylinder is provided for forcing a pelvic pad toward the lower back area of a user. A fourth pneumatic cylinder is provided for forcing a seat pad against,the user at a selected position adjacent the upper back or neck of a user.

6 Claims, 5 Drawing Sheets

PNEUMATIC ASSISTED EXERCISE BENCH

This application claims the benefit of Provisional application Ser. No. 60/253,187, filed Nov. 27, 2000.

BACKGROUND OF INVENTION

This invention relates to pneumatic assisted exercise bench that can be used to flex certain portions of a person's body to strengthen the person's back, spine, legs, and posture.

A need exists for exercise equipment which can be used by physical therapists, sports trainers and others to correct posture problems, to assist in preventing injuries to the neck and spine and to rehabilitate a neck or spine when an injury has occurred. This equipment needs to be versatile to accommodate persons of different size and persons with different neck or spine problems in need of correction. A need exists for equipment which can be used alone to perform many different exercises including lumbar exercises, thoracic exercises and cervical exercises.

SUMMARY OF INVENTION

The present invention includes a bench mounted to a base frame. A foot truck is slidably mounted to the bench to secure the feet of the user. A tiltable upper body support is mounted to the base. A first belt is provided for securing the legs of a user to the bench. A second belt is provided for securing the pelvic area of the user to the base. A third belt is connected to a support slidably mounted to the upper body support for mounting in a vertical direction. The third belt is used to secure the user to the upper body support. A first pneumatic cylinder is provided for extending the foot track to a selected forward position. A second pneumatic cylinder is provided for tilting the upper body support to a selected tilt position. A third pneumatic cylinder is provided for forcing a pelvic pad toward the lower back area of a user. A fourth pneumatic cylinder is provided for forcing a seat pad against the user at a selected position adjacent the upper back or neck of a user.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
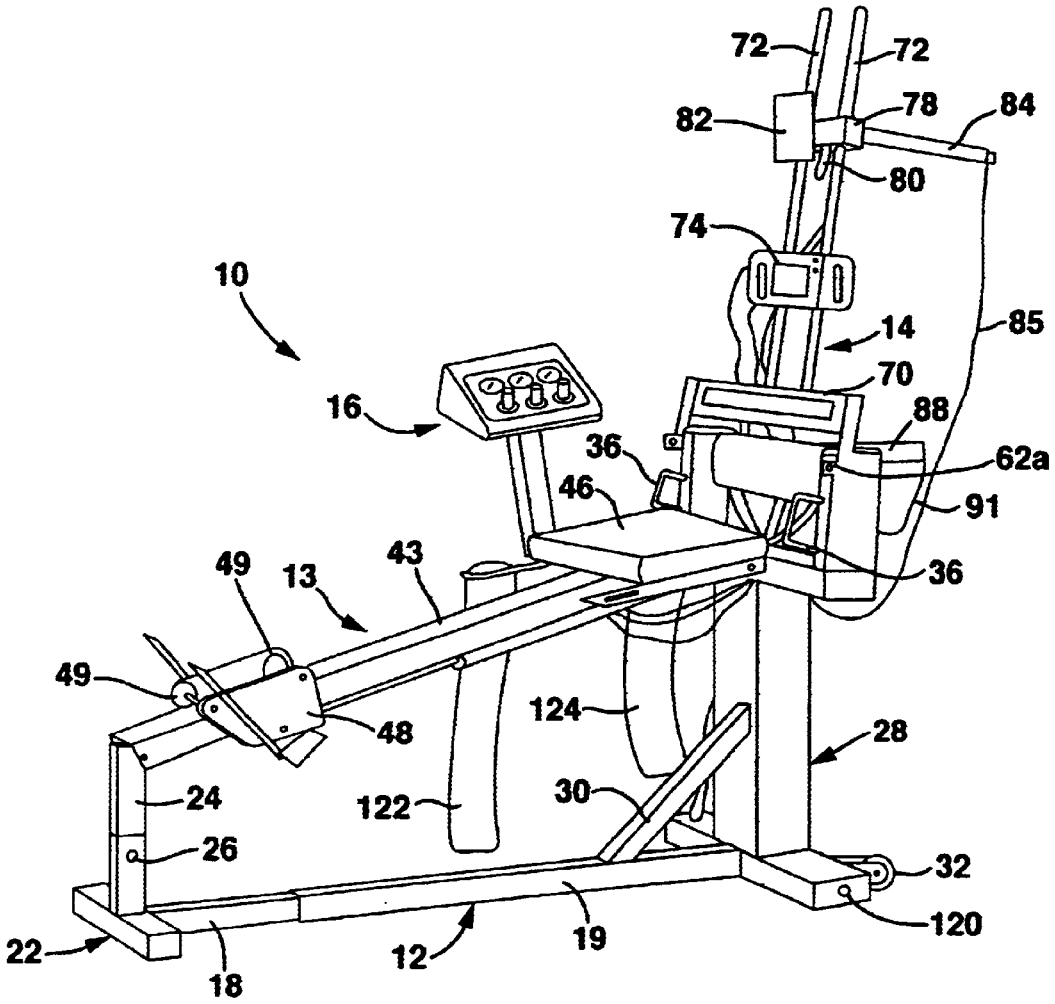
FIG. 1 is a right side perspective view of a pneumatic assisted exercise bench according to the present invention.
Figure 2:
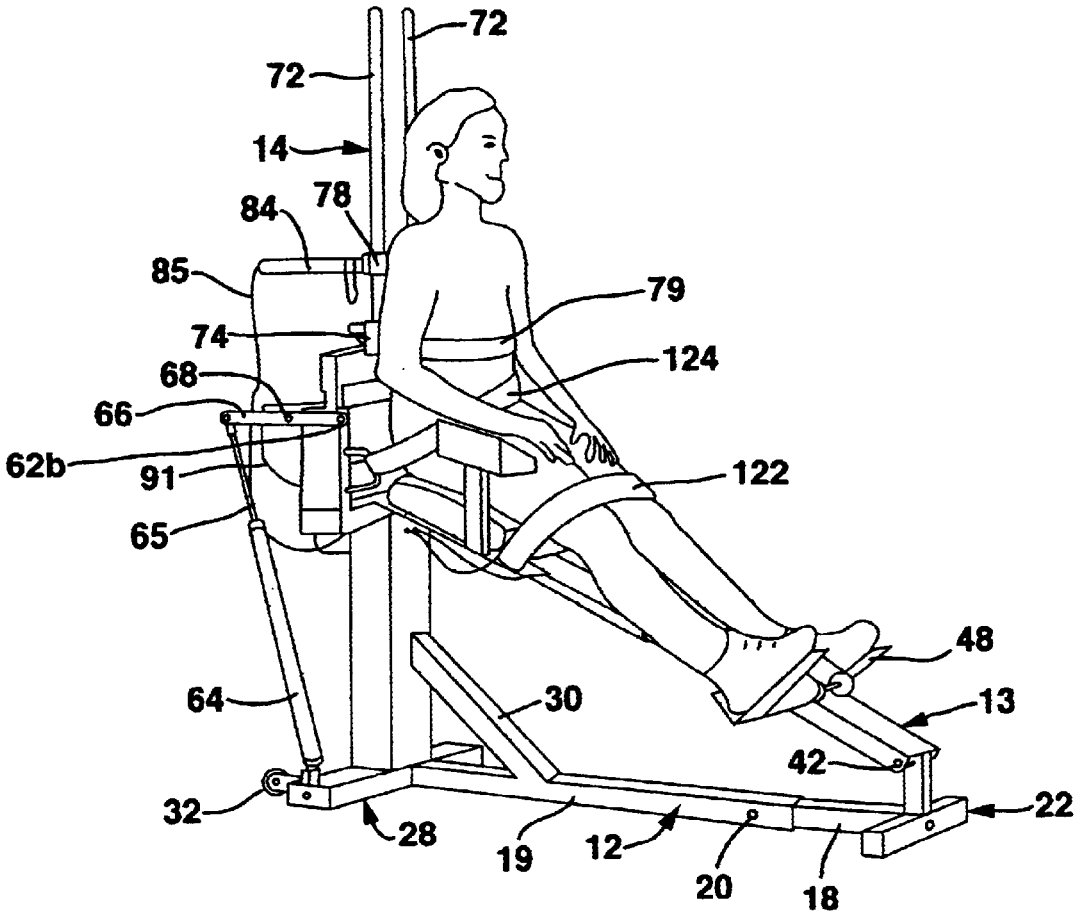
FIG. 2 is a left side perspective view of the pneumatic assisted exercise bench shown in FIG. 1.

A pneumatic assisted exercise bench 10 is shown in FIGS. 1 and 2. As shown in FIGS. 1 and 2, the pneumatic assisted exercise bench 10 of the present invention has three major subassemblies: a base 12, a bench 13, an upper body tilting mechanism 14, and a control panel 16.

Figure 3:
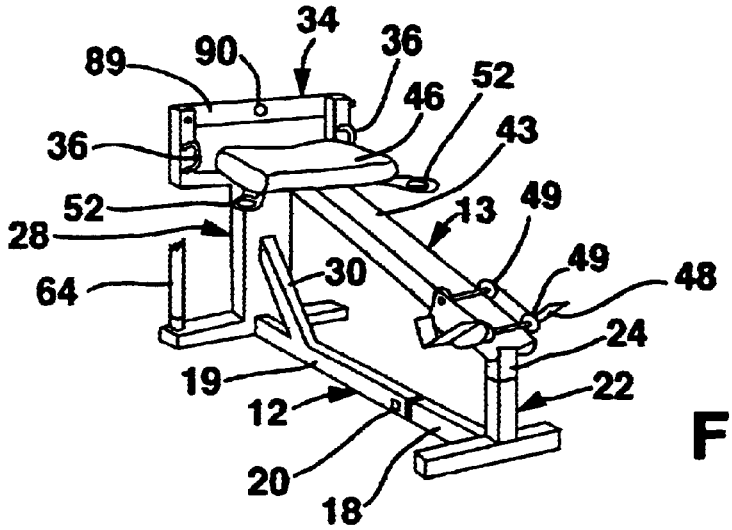
FIG. 3 is a left side perspective photograph of the pneumatic assisted exercise bench shown in FIG. 1 with parts removed.

The base 12 and bench 13 are shown in FIG. 3. Base 12 has a telescoping bar 18 which can be locked at a desired extension with respect to tube 19 by knob 20 shown in FIGS. 2 and 4. A front upright T-support 22 is secured as by welding to a forward end of bar 18. Front T-support 22 includes an adjustable telescoping riser 24 that can be raised and lowered and then locked into place with threaded knob 26 as shown in FIG. 1. The front T-support 22 has a vertical portion extending away from the floor as shown in FIG. 1, and a crossed portion resting on the floor.

At the rearward end of tube 19, a rear upright T-support 28 is fixedly connected to tube 19 as by welding. On the top side of tube 19, a brace 30 is fixedly connected between T-support 28 and tube 19 as shown in FIG. 1. Wheels 32 (shown in FIGS. 1 and 5) are fixedly connected to T-support 28 so that bench 10 may be moved when the bench is rotated over the wheels.

Figure 5:
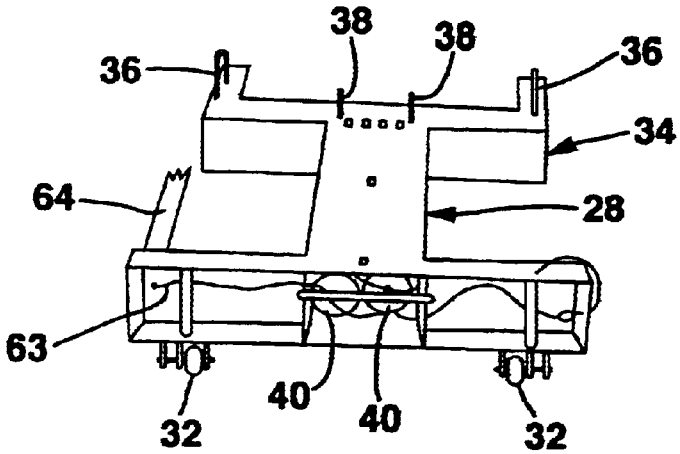
FIG. 5 is a detail front perspective view of a bench support shown in FIG. 3.

At an upper end of T-support 28, as shown in FIG. 3, a rectangular frame 34 is fixedly connected to T-support 28. On both opposite, shorter sides of rectangular frame 34, seat belt brackets 36 (as shown in FIGS. 1, 3 and 5) extend forwardly. Also, axle mounting brackets 38 are mounted to frame 34 as shown in FIG. 5. The vertical riser of T-support 28 has a tubular construction as shown in FIG. 5. A pair of accumulator bottles 40 are secured within the interior. Bottles 40 permit pneumatic pressure to be stored in the bottles for subsequent use in the system.

Figure 4:
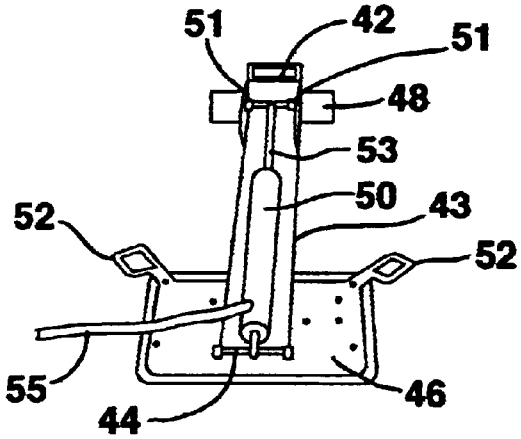
FIG. 4 is a detail bottom perspective view of a bench shown in FIG. 3.

As shown in FIGS. 3 and 4, the bench 13 includes a "v"—channel member 43. A front axle 42 pivotally connects a front end of member 43 to front T-support 22. A rear axle 44 pivotally connects a rear end of member 43 to brackets 38 (shown in FIGS. 4 and 5) of T-support 28. A seat 46 is fixedly connected to the top of member 43 as shown in FIG. 3. Adjacent the opposite end of member 43, a moveable foot truck 48 is provided. This foot truck 48 is provided with rollers 49 to allow the truck 48 to roll along the top side of member 43 (as shown in FIGS. 1 and 3). The foot truck 48 also includes rollers 51, shown in FIG. 4, to allow truck 48 to roll beneath the member 43.

As shown in FIG. 4 beneath member 43, a pneumatic cylinder 50, which in the preferred embodiment is a single-acting pneumatic cylinder, is connected to axle 44. A piston shaft 53, actuated by pneumatic cylinder 50, is connected to the foot truck 48 as shown in FIG. 4. Air under pressure is introduced to pneumatic cylinder 50 through air hose 55 to extend the shaft 53 and thus the foot truck 48.

Knee belt tie-down brackets 52 are fixedly mounted on opposite sides of seat 46 so as to extend outward from the seat.

Figure 6:
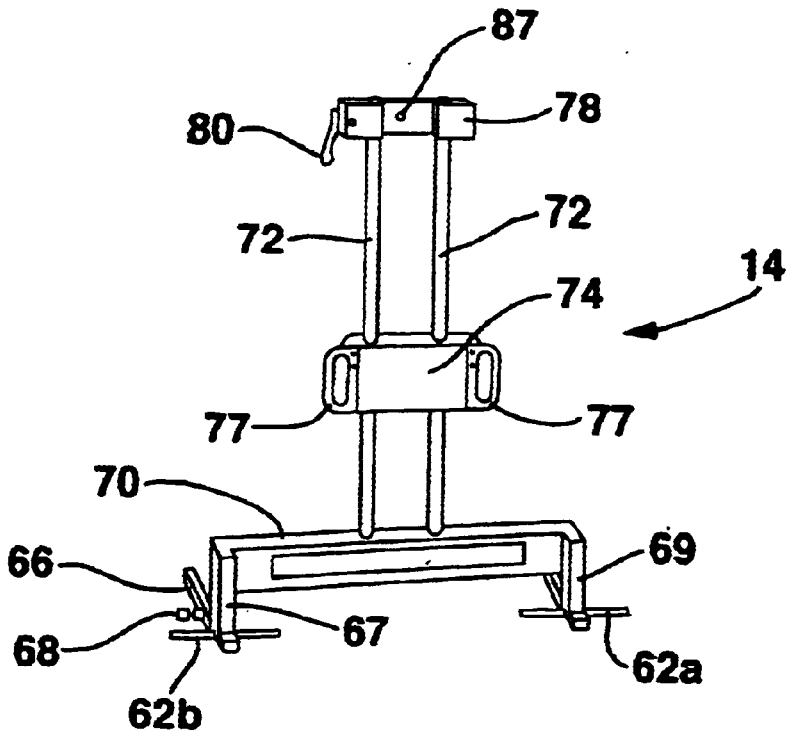
FIG. 6 is a detail front perspective view of a back and head support system shown in FIG. 1.

The upper body tilting mechanism 14, a major subassembly of the invention, is pivotally mounted to rectangular frame 34 by axles 62*a* and 62*b* as shown in FIGS. 1, 2 and 6. Along one side, tilting mechanism 14 has a pneumatic cylinder 64 connected to T-support 28 (as shown in FIG. 2). The cylinder 64 activates a piston shaft 65 which has its free end connected to an arm 66 connected to a side member 67 of tilting mechanism 14 as shown in FIGS. 2 and 6. Air under pressure is supplied to cylinder 64 through line 63 (shown in FIG. 5). The pneumatic pressure causes piston 65 to extend. This causes arm 66 to rotate forwardly which in turn causes tilting mechanism 14 to tilt in a forward direction. The length of leverage arm 66 can be changed by loosening knob 68, adjusting the length of the leverage arm, and then re-tightening knob 68.

A cross-member 70, of tilting mechanism 14, is positioned to extend across the top of rectangular frame 34 as shown in FIGS. 1 and 6. Cross-member 70 extends between side member 67 and an air opposite side member 69, as shown in FIG. 6. The side member 67 is pivotally attached to frame 34 with axle 62*b* and side member 69 is pivotally attached to frame 34 with axle 62*a*.

Figure 8:
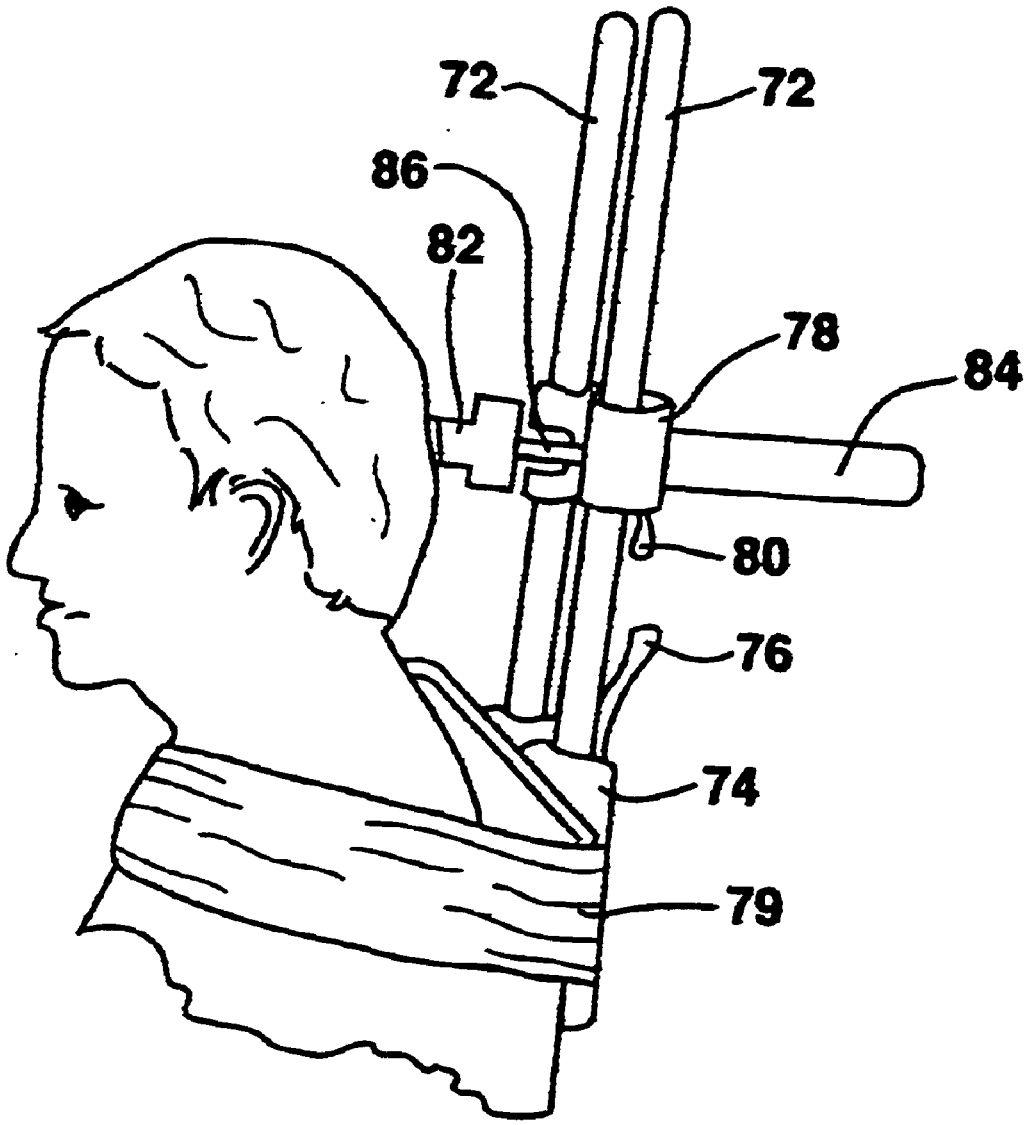
FIG. 8 is a left side perspective view of a person strapped to the pneumatic assisted exercise bench for thoracic exercise.

A pair of parallel rods 72 each have one end fixedly connected to cross-member 70 so that the rods 72 extend in a vertical direction. A belt bracket 74 is slidably mounted to rods 72 so that bracket 74 can be moved along parallel rods 72. A locking handle 76 is provided (as shown in FIG. 8) and is used to frictionally lock bracket 74 to rods 72 at a selected position. The bracket 74 is provided with a pair of fixed "D"-rings 77 on opposite sides of bracket 79 as shown in FIG. 6 for receiving a restraining belt 79, as shown in FIG. 2.

A sliding support member 78 is slidably mounted on parallel rods 72 above belt bracket 74, as seen in FIGS. 1, 2, 6 and 8. Handle 80 (as seen in FIGS. 6 and 8) is used to frictionally lock support 78 at a selected position on parallel rods 72.

A rest 82 is fixedly mounted to a free end of piston shaft 86 extending from a single-acting pneumatic cylinder 84, as shown in FIG. 8. The pneumatic cylinder is fixedly attached to support 78 with the piston shaft 86 extending through a hole 87 provided in support 78, as shown in FIG. 6. As pressure is introduced into pneumatic cylinder 84 through line 85 the piston 86 pushes rest 82 against a user's head, as shown in FIG. 8, or against a user's back, as shown in FIG. 2, depending on where the support 78 is located.

A single-acting pneumatic cylinder 88 is fixedly connected to rectangular frame 34. A piston shaft (not shown) extends from cylinder 88 through a hole 90 (shown in FIG. 3) provided in an upper frame member 89 of frame 34. A pelvic pad 92 is fixedly mounted to a free end of the piston extending from cylinder 88.

As air under pressure is introduced into cylinder 88 through line 91, the piston pushes pelvic pad 92 against the pelvic area of the user. Lines 91 and 84 are connected together so that the same air pressure is delivered to pneumatic cylinders 84 and 88.

Figure 7:
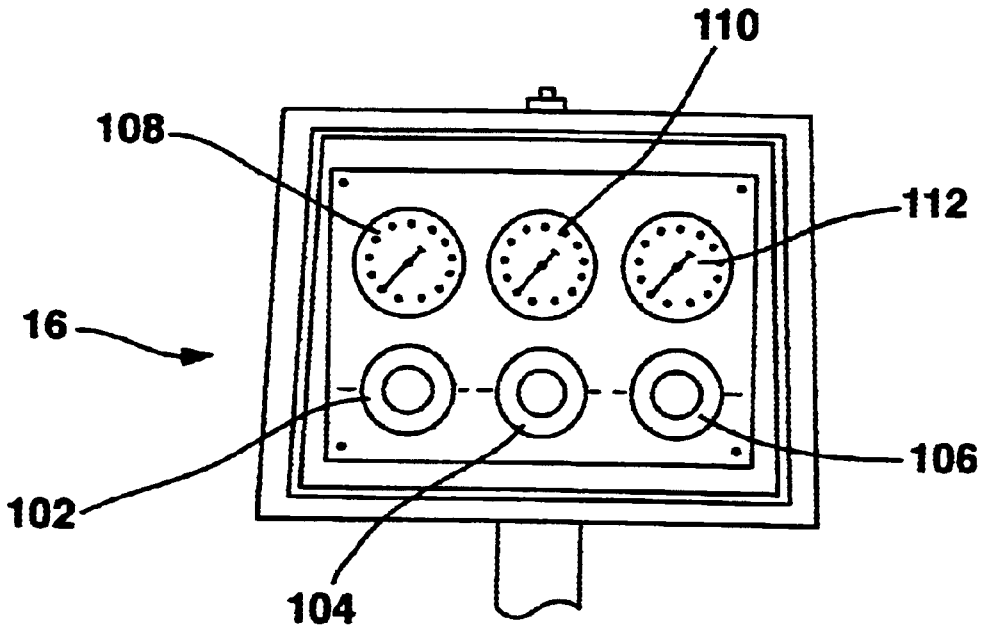
FIG. 7 is a detail front view of a control panel shown in FIG. 1.

Control panel 16, as shown in FIGS. 7 and 8, is mounted to member 43 of bench 13 (as shown in FIG. 1) using conventional hardware.

Control panel 16 incorporates adjustable pressure valves for adjusting the air pressure from accumulating cylinders 40 (shown in FIG. 5) to pneumatic cylinders 50, 64, 84 and 88 together with associated pressure gauges. In particular, valve 102 controls the air to cylinder 50 through line 55. Pressure gauge 108 indicates the air pressure in line 55. Valve 104 controls the air to cylinder 64 through line 63 (shown in FIG. 5). Pressure gauge 110 indicates the air pressure in line 63. Valve 106 controls the air to both cylinders 84 and 88 through lines 85 and 91 respectively. Pressure gauge 112 indicates the air pressure in these lines. If a valve is turned beyond the "off" position, pressure will be released from the associated cylinder; if the valve is turned in the opposite direction, more pressure will be applied to the associated cylinder.

Since all four cylinders used in this invention are single-acting, i.e. if pressure is introduced at one end of the cylinder, an internal piston is driven toward the opposite end of the cylinder, the amount of pressure applied to a particular Ad piston is determined by one of the three valves on control panel 16.

Pressurized air is introduced to bench 10 through air inlet 120 as shown in FIG. 1 and led through a tube (not shown) to accumulator bottles 40 positioned in T-support 28. Tubes (not shown) are then led from accumulator bottles 40 to each of the three valves: valves 102, 104, and 106 respectively. The output of each of these valves is led through the lines 55, 63, 85 and 91 to one end of the associated cylinders these lines between the three valves and these three destinations (four cylinders).

As seen in FIG. 2, knee belt 122, seat belt 124, and upper chest belt 79 hold a person securely against bench 10 as bench 10 is being used.

In operation, pneumatic assisted exercise bench 10 is pivoted on wheels 32 and moved to a position clear of obstructions and then set upright on a floor as shown in FIG. 1. Knob. 20 is used to lock bar 18 at the proper extension. Leverage arm 66 is adjusted with knob 68 to be of the correct length for the amount of tilt of tilting mechanism 14 desired. Air from an external air compressor is then connected to air inlet 120! shown in FIG. 1, so as to pressurize accumulator bottles 40.

Once a person is seated on seat 46, belt bracket 74 is moved to a selected position immediately behind a person's back and tightened in place on parallel rods 72 using handle 76. Support 78 is moved along parallel rods 72 to a proper location depending on whether the person is to perform cervical or thoracic exercises. Support 78 is tightened in place by handle 80.

The person is then strapped to the pneumatic assisted rig exercise bench 10 using belts 79, 122 and 124. Knee belt 122 is tightened across their knees by attaching the knee belt to brackets 52 attached to seat 46; seat belt 124 is secured to seat belt brackets 36 attached to upright T-support 28; and upper chest belt 126 is secured to "D"-rings 77 attached to belt bracket 74.

The person, while seated on bench 10, can then control pressures entering all the cylinders by using valves 102, 104, and 106 and monitoring the pressures with respective pressure gauges: gauges 108, 110, and 112. If a valve is turned beyond the "off" position, pressure will be released from the associated cylinder; if a valve is turned in the opposite direction, more pressure will be applied to the associated cylinder.

The person then places his feet in the foot truck 48. When the person pushes against the pressure of foot truck 48, he is pushing against the "soft" forces provided by pneumatic cylinders 50, 64, 84 and 88. This pushing helps to strengthen isolated muscle groups which assists in improving posture. For example, with the rest 82 positioned against the head of a user and the belt 126 positioned adjacent the shoulder area of a user, as Bit shown in FIG. 8, cervical exercises may be performed. With the rest 82 positioned against the thorax of a user and the belt 79 positioned around the lower chest area of a user, as shown in FIG. 2, thoracic exercises may be performed. Further, with the rest 82 positioned against the head of a user and belt 126 left unused and with the upper body tilting mechanism 14 tilted forwardly, various lumbar exercises may be performed.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as described by the following claims.

What is claimed is:

1. An exercise bench having a forward and rearward end comprising:

a base frame;

a bench mounted to the base frame;

the bench including an elongate member having a seat mounted adjacent a rearward end thereof;

an upper body support mounted to the base frame at a position above and behind the seat;

the upper body support having a vertically upright member;

a belt bracket slidably mounted to the upright member for movement in a vertical direction;

a belt attached to the belt bracket for securing a user to the upper body support;

a sliding member slidably attached to the upright member above the belt bracket for movement in the vertical direction;

a first pneumatic cylinder having an air inlet port and a piston;

the first pneumatic cylinder fixedly attached to the sliding member with the piston extending in a forward direction;

a rest pad attached to the free end of the piston;

whereby when the first pneumatic cylinder is pressurized, the piston extends in the forward direction causing the rest pad to push against a user seated on the bench;

a source of pressurized air fluidly connected to the inlet port of the first pneumatic cylinder; and control means for adjustably controlling the air pressure to the first pneumatic cylinder.

2. An exercise bench according to claim 1 further including a second pneumatic cylinder having an air inlet port and a piston;

the second pneumatic cylinder attached to the base frame at a position above and behind the seat with the piston extending in a forward direction;

a pelvic pad attached to the free end of the piston;

whereby when the third pneumatic cylinder is pressurized, the piston extends causing the pelvic pad to push against a user seated on the bench;

the source of pressurized air fluidly connected to the inlet port of the second pneumatic cylinder and wherein the control means adjustably controls air pressure to the second pneumatic cylinder; and a strap connected to the base frame for securing the pelvic area of the user against the pelvic pad.

3. The exercise bench according to claim 1 wherein the upper body support is pivotally mounted to an axle mounted to the base at a position above and behind the seat and tiltable in a forward direction to a selected position.

4. The exercise bench according to claim 3 further including:

a third pneumatic cylinder having an air inlet port in the piston;

an arm fixedly secured to the upper body support with a free end extending in a direction perpendicular to the axle in a rearward direction;

the second pneumatic cylinder attached to the base frame and the piston connected to the free end of the arm whereby when the third pneumatic cylinder is pressurized, the piston extends causing the arm and upper body support to pivot around the axle in a forward direction; and wherein the source of pressurized air is fluidly connected to the inlet port of the third pneumatic cylinder and the control means includes means for adjustably controlling air pressure to the third pneumatic cylinder.

5. The exercise bench according to claim 1 further including a foot truck slidably mounted to the elongate member at a position spaced apart from the seat toward the forward end;

a fourth pneumatic cylinder having an air inlet port piston;

the fourth pneumatic cylinder attached to the base frame adjacent the seat and the piston connected to the foot truck whereby when the first pneumatic cylinder is pressurized the piston extends causing the foot truck to be slidably moved away from the seat;

a strap connected to the bench for wrapping over the knees of the user to secure the legs of the user to the bench; and wherein the source of pressurized air is fluidly connected to the inlet port of the fourth pneumatic cylinder and the control means includes means for adjustably controlling air pressure to the fourth pneumatic cylinder.

6. An exercise bench having a forward end and a rearward end comprising:

a base frame;

a bench mounted to the base frame;

the bench including an elongate member having a seat mounted adjacent a rearward end thereof;

a foot truck slidably mounted to the elongate member at a position spaced apart from the seat toward the forward end;

a first pneumatic cylinder having an air inlet port and a piston;

the first pneumatic cylinder attached to the base frame adjacent the seat and the piston connected to the foot truck whereby when the first pneumatic cylinder is pressurized the piston extends causing the foot truck to be slidably moved away from the seat;

an upper body support pivotally mounted to an axle mounted to the base frame at a position above and behind the seat;

the upper body support having a vertically upright member;

a second pneumatic cylinder having an air inlet port and a piston;

an arm fixedly secured to the upper body support with a free end extending in a direction perpendicular to the axle in a rearward direction;

the second pneumatic cylinder attached to the base frame and the piston connected to the free end of the arm;

whereby when the second pneumatic cylinder is pressurized the piston extends causing the arm and upper body support to pivot above the axle in a forward direction;

a third pneumatic cylinder having an air inlet port and a piston;

the third pneumatic cylinder attached to the base frame at a position above and behind the seat with the piston extending in a forward direction;

a pelvic pad attached to the free end of the piston;

whereby when the third pneumatic cylinder is pressurized the piston extends causing the pelvic pad to push against a user seated on the bench;

a belt bracket slidably mounted to the upright member for movement in a vertical direction;

a belt attached to the belt bracket for securing the user to the upper body support;

a sliding member slidably attached to the upright member above the belt bracket for movement in the vertical direction;

a fourth pneumatic cylinder having an air inlet port and a piston;

the fourth pneumatic cylinder fixedly attached to the sliding member with the piston extending in a forward direction;

a rest pad attached to the free end of the piston;

whereby when the fourth pneumatic cylinder is pressurized the piston extends in the forward direction causing the rest pad to push against a user seated on the bench;

a strap connected to the bench for wrapping over the knees of the user to secure the legs of the user to the bench;

a strap connected to the base frame for securing the pelvic area of the user against the pelvic pad;

a source of pressurized air fluidly connected to the inlet ports of the first, second, third and fourth pneumatic cylinders; and control means for adjustably controlling air pressure to each of the four pneumatic cylinders.

* * * * *